United States Patent [19]

Sharrah

[11] Patent Number: 4,905,129

[45] Date of Patent: Feb. 27, 1990

[54] FLASHLIGHT WITH TAIL CAP SWITCH

[76] Inventor: Raymond L. Sharrah, 661 Barrington Rd., Collegeville, Pa. 19426

[21] Appl. No.: 257,333

[22] Filed: Oct. 13, 1988

[51] Int. Cl.[4] ..... F21L 7/00

[52] U.S. Cl. ..... 362/158; 362/187; 362/206; 200/60

[58] Field of Search ..... 362/158, 187, 189, 205, 362/206, 204, 202, 110, 119; 200/60

[56] References Cited

U.S. PATENT DOCUMENTS

| | | | |
|---|---|---|---|
| Re. 29,047 | 11/1976 | Brindley | 362/205 |
| 1,265,820 | 5/1918 | Seymour | 362/206 |
| 1,782,015 | 11/1930 | Sachs | 362/206 |
| 2,070,316 | 2/1937 | Recker et al. | 362/206 |
| 2,256,641 | 9/1941 | Fullmer | 362/206 |
| 2,443,539 | 6/1948 | Kopp | 200/60 |
| 3,459,907 | 8/1969 | Garland | 200/60 |
| 3,665,178 | 5/1972 | Sussingham et al. | 362/189 |
| 3,924,116 | 12/1975 | Brindley | 362/205 |
| 4,109,405 | 8/1978 | Ito | 362/158 |
| 4,135,230 | 1/1979 | Armbruster | 362/206 |
| 4,306,277 | 12/1981 | Bodde | 362/206 |
| 4,484,253 | 11/1984 | Roberts | 362/206 |
| 4,733,337 | 3/1988 | Bieberstein | 362/206 |
| 4,737,892 | 4/1988 | Ohashi | 362/206 |

FOREIGN PATENT DOCUMENTS

| | | | |
|---|---|---|---|
| 202267 | 4/1939 | Switzerland | 362/118 |

*Primary Examiner*—Ira S. Lazarus
*Assistant Examiner*—D. M. Cox
*Attorney, Agent, or Firm*—Steele, Gould & Fried

[57] ABSTRACT

A flashlight having a tail cap switch is disclosed. The tail cap is formed to fit in one end of the flashlight barrel for retaining one or more power cells therein. It is easily removable for replacement of the flashlight power cells. The tail cap has an integral switch for connecting and disconnecting the flashlight bulb to and from the power cells. A flexible boot is provided for enclosing an exposed portion of the switch when the tail cap is installed in the flashlight barrel. The flexible boot, which is formed of a resilient, water-resistant material, has a peripheral sealing portion which is formed to fit between the switch body and the barrel so as to form a watertight seal therebetween.

18 Claims, 3 Drawing Sheets

FLASHLIGHT WITH TAIL CAP SWITCH

BACKGROUND OF THE INVENTION

This invention relates generally to small, hand-held flashlights, and in particular, to a small, focusable beam flashlight having a watertight tail cap with an integral switching mechanism.

Heretofore, small flashlights of the type including a barrel portion for holding one or more dry cell batteries were known to include tail cap switches. For example, U.S. Pat. No. 4,484,253 issued to Roberts on Nov. 20, 1984 relates to a flashlight having a tail cap which incorporates a switching mechanism of the protracting-retracting type. The flashlight described in the Roberts patent leaves much to be desired because it includes a contact member which is coupled to a battery biasing spring at one end and which has an elongated leg portion which traverses the battery chamber to contact the light bulb. This contact member must be withdrawn when the batteries are replaced and thus is susceptible to damage or even breakage. Furthermore, the tail cap switch does not include any means for sealing out moisture which can infiltrate the flashlight causing shorting of the electrical connections or corrosion of the electrical contact therein.

U.S. Pat. No. 4,733,337 issued to Bieberstein on Mar. 22, 1988 relates to a flashlight having a switch located in the end cap of the flashlight barrel. The end cap switch of the Bieberstein flashlight includes a diaphragm which apparently is intended to provide a fluid-tight seal between the mechanical elements of the switch and the electrical contacts thereof. The arrangement of the Bieberstein end cap switch is less than desirable because, in addition to the diaphragm, a separate sealing O-ring must be situated between the end cap and the flashlight barrel to provide a seal against moisture entering the flashlight proper.

SUMMARY OF THE INVENTION

Accordingly, it is a principal object of this invention to provide a focusable beam flashlight having a tail cap switch which is easy to remove and install for replacement of the dry cell batteries.

A further object of this invention is to provide such a flashlight wherein the tail cap includes a water-resistant enclosure for the switch having an integral sealing portion for providing a watertight seal between the switch body and the flashlight barrel.

A still further object of this invention is to provide such a tail cap switch which is easily interchangeable among similarly dimensioned flashlights and which can be retrofitted to such flashlights as an alternative switching mechanism.

The above and other objects are achieved in a flashlight which includes an elongated casing or barrel for holding one or more power cells. The casing has a head-end in which a light bulb is mounted. A head unit, including a lens and a reflector, fits over the light bulb when assembled to the casing. The casing also has an open tail-end. The flashlight further includes an electric circuit with an electrical switching mechanism for connecting and disconnecting the light bulb to and from the power cells. The switching mechanism is mounted and retained in the open tail-end of the casing so as to retain the power cells therein. A flexible boot, preferably formed of a resilient, water-resistant material, encloses a portion of the switching mechanism. The flexible boot has an open end including a peripheral sealing portion which is formed to fit between the switching mechanism and the casing so as to form a watertight seal therebetween. The switching mechanism together with the flexible boot constitute a watertight tail cap for the flashlight.

The switching mechanism according to the present invention includes a housing or body, which is formed to fit within the open tail-end of the flashlight casing. First and second resilient contacts are mounted in the housing but are electrically isolated from each other. A third resilient contact is connected to the second resilient contact and mounted exteriorly on the switch housing so as to contact one of the power cell terminals. A retractable bridging contact is provided for coupling and uncoupling the first and second resilient contacts in order to connect and disconnect the light bulb to and from the power cells.

BRIEF DESCRIPTION OF THE DRAWINGS

The foregoing summary, as well as the following detailed description of a preferred embodiment of the present invention, will be better understood when read in conjunction with the appended drawings in which.

DETAILED DESCRIPTION OF THE PREFERRED EMBODIMENT

Figure 1:
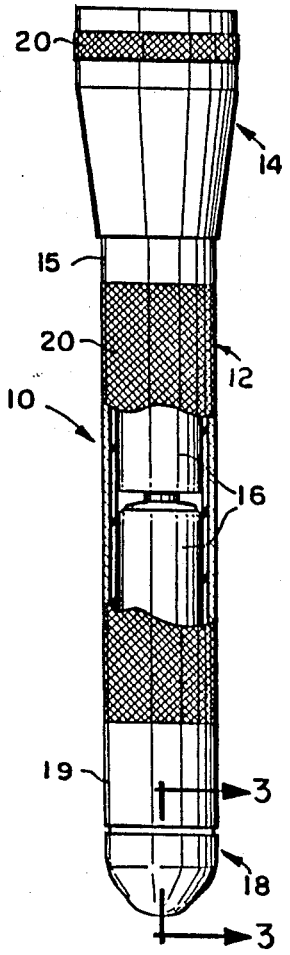
FIG. 1 is a partially cut-away view of a double power cell embodiment of a flashlight according to the present invention.

Referring now to the drawings wherein like reference numerals refer to identical or corresponding parts across the several views, and in particular to FIG. 1, there is shown generally an assembled flashlight 10 according to the present invention. The flashlight 10 includes an elongated barrel 12 having a head unit 14 at the head-end 15. The barrel 12 has sufficient length to contain a pair of power cells 16. A tail cap 18 is assembled to the tail-end 19 of barrel 12. The barrel 12 and head-unit 14 are preferably machined from aluminum. Knurling 20 is provided on the barrel 12 and the head unit 14 in order to make the flashlight easier to handle and adjust.

Figure 2:
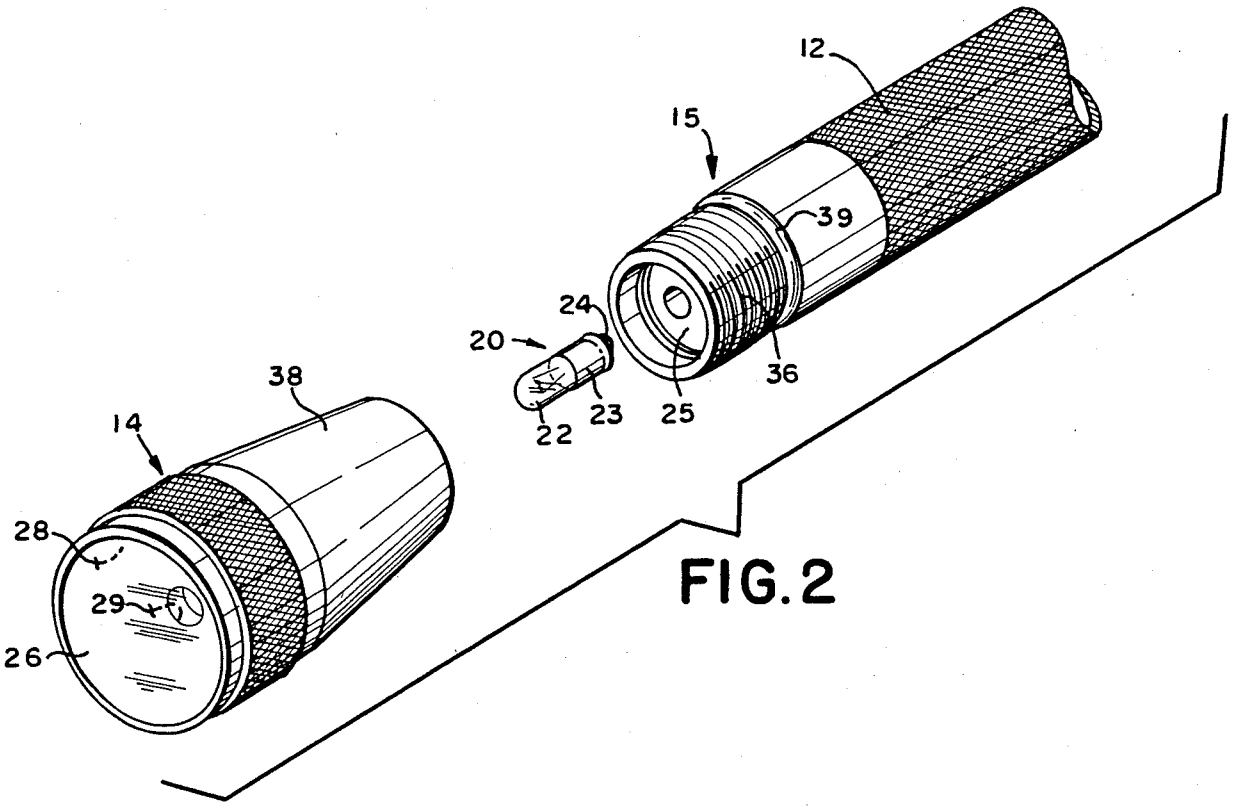
FIG. 2 is a fragmentary exploded view of the head end of a flashlight embodying the present invention.

The arrangement of the head-end of the flashlight is shown more clearly in FIG. 2. A light bulb 21 having a filament 22, a base 23, and a foot 24 is mounted in a socket 25 located in the head-end 15 of barrel 12. The base 23 is connected to one end of filament 22 and the foot 24 is connected to the other end. Socket 25 includes a base contact (not shown) which connects the base 23 of light bulb 21 with either the barrel 12 if formed of a conductive material such as aluminum or with a discrete conductor connected to the flashlight switch. The socket 25 also includes a foot contact (also not shown) which is electrically insulated from the base contact for providing a connection between the foot 24 of light bulb 20 and a terminal of one of the power cells 16. The particular structure of socket 25 has not been shown since such sockets are well known. Suffice it to say that the structure of the socket includes at least the base contact, foot contact, and an insulating medium as just described in any suitable, known arrangement.

The head unit 14 includes a transparent lens 26 which is preferably snap-fit into the head unit 14 so as to provide a waterproof seal therebetween. A substantially parabolic reflector 28 having a preselected focal point is mounted inside the head unit and held in place by the lens 26. Parabolic reflector 28 has a central opening 29 through which the light bulb 20 freely passes when the head unit 14 is assembled to the barrel 12. To this end, barrel 12 has a plurality of external threads 36 formed thereon at head end 15. Head unit 14 has a plurality of internal threads formed within the tapered portion 38 to mate with the threads 36 of barrel 12. The head unit 14 is assembled to the barrel 12 by threading the former onto the latter. Sealing means, in the present instance an O-ring 39 is compressed between the inside of the head unit 14 and the outside of the barrel 12 to exclude dirt and moisture from the cooperating internal and external threads 36. Furthermore, sufficient threads 36 are provided such that the head unit 14 can be translated axially along the barrel 12 for a preselected distance. In this manner, the parabolic reflector 28 moves relative to the filament 22 of light bulb 20 thereby focusing a light beam emanating from the light bulb 21 from a broad flood-type beam to a narrow spot-type beam or vice versa, as desired.

Figure 3:
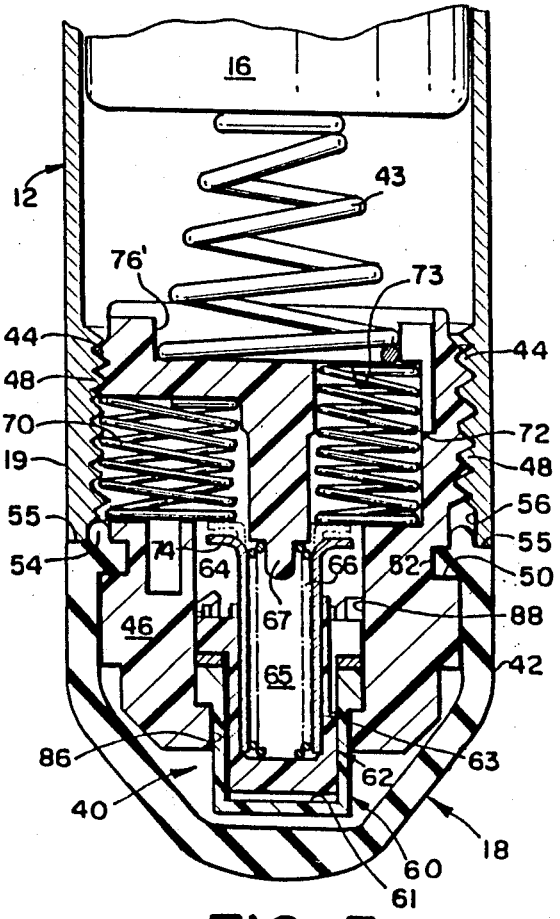
FIG. 3 is a sectional view of the tail cap switch of the flashlight, as viewed along line 3—3 of FIG. 1.

Referring now to FIG. 3 the tail cap 18 is shown in greater detail. Tail cap 18 includes a pushbutton switch 40 and a flexible domed boot 42 which encloses the portion of switch 40 extending outside the barrel 12. The switch 40 includes a switch body or housing 46 preferably formed of a rigid, non-conducting material. Switch 40 is retained in barrel 12 by a plurality of external helical threads 44 formed in the switch body 46. The helical threads 44 are formed to mate with similar size internal helical threads 48 formed in the tail-end of barrel 12.

The domed boot 42 is preferably formed of a resilient, water-resistant imperforate sheet material, such as rubber, in order to provide a fluid or moisture barrier enclosing the pushbutton switch 40. Flexible boot 42 has an inwardly directed lip 50 which circumscribes the interior of the open end of the boot. The lip 50 is formed to fit within an annular groove 52 formed in the body 46 of pushbutton switch 40. A sealing bead 54 extends from the end face 55 of boot 42 and also circumscribes the open end thereof. In the embodiment shown in FIG. 3 the sealing bead 54 extends in a direction which is perpendicular to that of the lip 50 and is formed to fit within an annular region 56 between the barrel 12 and the switch housing 46. When the tail cap 18 is assembled to the flashlight barrel 12 as shown in FIG. 3, the lip 50 and bead 54 form a water tight seal between the barrel 12 and the switch body 46. The sealing bead 54 also acts as a stiffener to prevent puckering of the boot 42 as the switch 40 is tightened into the barrel 12.

The pushbutton switch 40 is connected to a terminal of power cell 16 by means of a coil spring contact 43. The spring contact 43 is sufficiently stiff to bias power cell 16 against the light bulb socket 25 at the other end of barrel 12 when the tail cap 18 is tightened in place.

An electric circuit, including the pushbutton switch 40, is provided for energizing and de-energizing the light bulb 21. The electric circuit includes a first circuit leg composed of the base contact of socket 25 and the barrel 12, if made of aluminum, or a discrete conductor extending from the base contact to the tail-end 19 of the barrel 12, if the barrel is made of a non-conductive material. The first circuit leg terminates in the pushbutton switch 40 in a manner to be described in greater detail below. A second circuit leg is composed of the foot contact of socket 25, the power cells 16 and the coil spring contact 43. The second circuit leg terminates in the pushbutton switch 40 in a manner to be described further hereinbelow.

Figure 4:
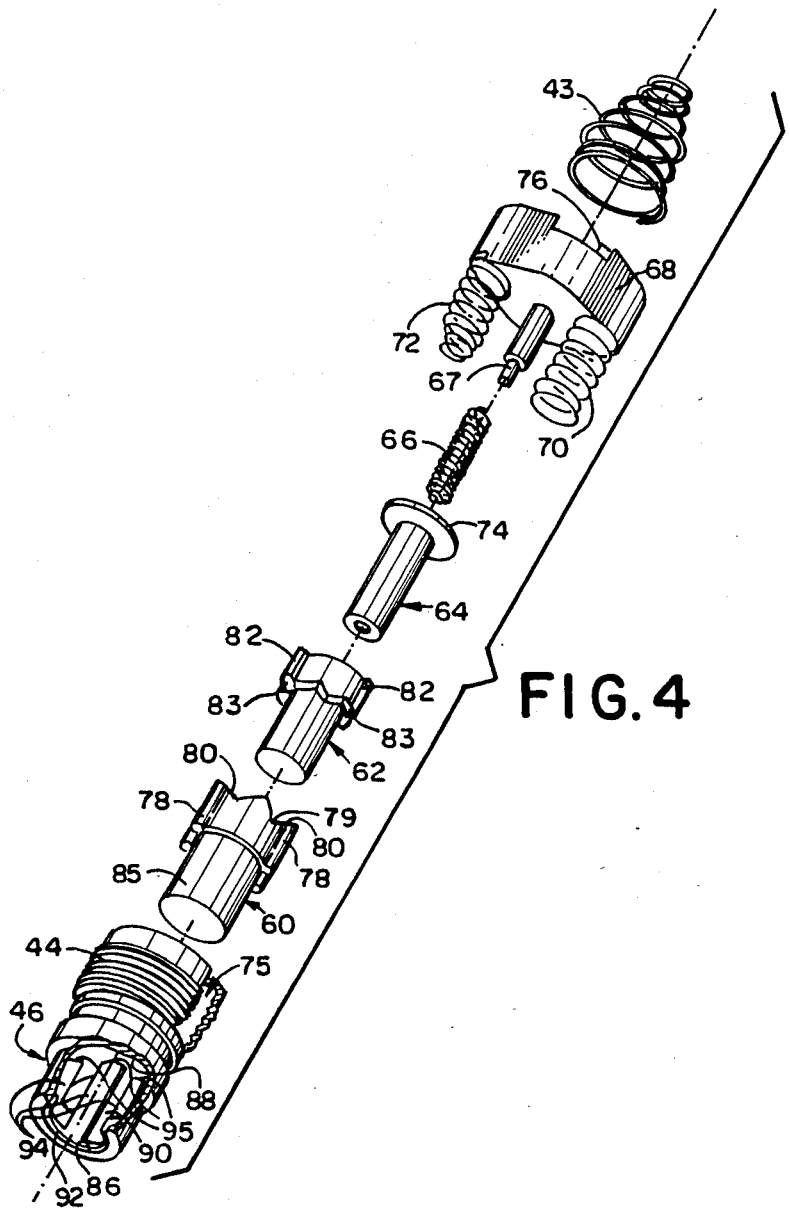
FIG. 4 is a fragmentary exploded view of a pushbutton switch according to the present invention.

The switching mechanism of pushbutton switch 40 may be more clearly understood by now referring to FIG. 3 together with FIG. 4. Pushbutton switch 40 includes a pushbutton 60 having a hollow recess 61, a plunger 62 also having a hollow recess 63, and a bridging contact 64 also having a hollow recess 65. A biasing spring 66 fits within the recess 65 and fits over a stem 67 extending from the center of a contact support base 68. A second spring contact 70 is mounted on the contact support base 68 to one side of stem 67. A third spring contact 72 is mounted in an opening 73 through contact base 68 on the other side of stem 67. In the embodiment shown in FIGS. 3 and 4, the spring contacts 70 and 72 respectively, are embodied as generally cylindrical coil springs having electrically conductive wire convolutions with their major axes parallel to each other. Spring contact 43 is a tapered coil having electrically-conductive spring wire convolutions seated in a recess 76 formed in the exterior of the contact support base 68. The spring contact 72 protrudes through the opening 73 in contact base 68 for electrical connection with spring contact 43. Spring contact 72 thereby terminates the second circuit leg in pushbutton switch 40.

The spring contact 70 is located adjacent a window or slot 75 in a sidewall of switch body 46. The coils of spring contact 70 can thereby interface with the threads 48 cut in the barrel 12, if formed of aluminum, to terminate the first circuit leg in pushbutton switch 40. Similarly, the spring contact 70 may interface with a discrete conductor when the barrel 12 is formed of a non-conductive material.

The bridging contact 64 selectively couples and uncouples the contacts 70 and 72 and is nested within the hollow recess 63 of plunger 62 which in turn is nested within the hollow recess 61 of pushbutton 60. A shaft portion 85 of pushbutton 60 is formed to extend through and to slide within an access opening 86 in switch body 46. The bridging contact 64 has a rim 74 disposed around the end adjacent the spring contacts 70 and 72. Thus, when pushbutton 60 is depressed, the rim 74 is brought into contact with both of the spring contacts 70 and 72 as shown by the dashed outline in FIG. 3, thereby completing the circuit between the light bulb 20 and the power cells 16.

Pushbutton 60 is provided with a plurality of slide members 78 equilaterally spaced around the open end 79 of pushbutton 60. Each slide member 78 has a pair of inclined surfaces 80 at one end thereof. Plunger 62 has a plurality of ribs 82 equilaterally spaced around its open end. Each rib 82 has a single inclined surface at the end facing pushbutton 60. Similarly, the switch body 46 has a plurality of internal guides formed in the interior chamber 88 of switch body 46. The guides are embodied as deep guides 90 alternating with shallow guides 92, both of which are formed to receive the slide members 78 of pushbutton 60 and the ribs 82 of plunger 62. The guides are demarcated by means of ribs 94 formed in chamber 88. Each rib 94 has an inclined surface 95 at its end. The foregoing arrangement of slide members, guides, and inclined surfaces operates similarly in principal to a conventional pushbutton mechanism of the protract-retract type commonly used in retractable ballpoint pen mechanisms. Such a mechanism is shown and described in U.S. Pat. No. 4,733,337. The operation of such mechanisms is well known and will not be described further herein. Suffice it to say that the above-described pushbutton switch 40 operates to maintain the bridging contact 64 in contact with both the spring contacts 70 and 72 when in the protracted position, thereby completing the electrical circuit. The pushbutton switch 40 further operates to maintain the bridging contact 64 out of contact with the spring contacts 70 and 72 when in a retracted position, thereby opening the electric circuit.

Some of the many novel features and advantages of the present invention are now apparent in view of the foregoing detailed description. For example, a flashlight has been described which includes a tail cap switch which is easy to remove and install for replacement of the power cells. The tail cap includes a flexible boot which encloses a portion of the switch mechanism in the tail cap. The boot is formed of a resilient, water-resistant material and has a sealing portion formed to provide a watertight seal between the switch body and the flashlight barrel.

The tail cap switch is designed to be easily interchangeable among similarly dimensioned flashlight barrels and can be retrofitted to such flashlights as an alternative switching device.

It will be recognized by those skilled in the art that changes or modifications may be made to the above-described embodiment without departing from the broad inventive concepts of the invention. It is understood, therefore, that the invention is not limited to the particular embodiments which are disclosed, but is intended to cover all modifications and changes which are within the scope and spirit of the invention as defined in the appended claims.

What is claimed is:

1. A flashlight comprising:

an elongated casing for holding one or more power cells, said casing having a head-end and an open tail-end;

a light bulb mounted at the head-end of said casing;

an electric circuit including electrical switching means for connecting and disconnecting said light bulb to and from the power cells, said switching means being mounted in the open tail-end so as to retain the power cells in said casing;

means for retaining said electrical switching means in the tail-end such that said switching means can be easily removed and re-mounted;

an imperforate flexible boot for enclosing a portion of said switching means, said flexible boot having an open end including a peripheral sealing portion formed to fit between said switching means and said casing so as to form a watertight seal therebetween when said switching means is mounted in the tail-end of said casing;

said flexible boot being dome-shaped and formed of a resilient water-resistant material; and said switching means comprising a switch housing having a peripheral groove formed therein, and the sealing portion of said flexible boot comprising:

an inwardly directed lip extending substantially around the open end, said lip being dimensioned and positioned to fit within the switch housing grooves, a bead projecting perpendicularly from said lip and extending substantially around the open end in an annular region between the switch housing and said casing, and said lip and bead being operable to provide a water-proof seal between said housing and said casing when said switching means is mounted in the casing.

2. A flashlight as recited in claim 1 further comprising a head unit mounted over the head end for enclosing said light bulb and means providing a water-proof seal excluding entry of dirt and moisture into said head unit.

3. A flashlight as recited in claim 2 wherein said head unit comprises a sealed lens and a reflector having an opening dimensioned and positioned to permit said light bulb to pass freely therethrough.

4. A flashlight as recited in claim 3 wherein said reflector has a focal point and the flashlight further comprises means for controllably translating said head unit relative to said casing such that a light beam emanating from said light bulb is focused by said reflector.

5. A flashlight as recited in claim 1 wherein said electrical switching means comprises a pushbutton switch.

6. A flashlight comprising:

an elongated casing for holding one or more power cells, said casing having a head-end and an open tail-end;

a light bulb mounted at the head-end of said casing;

an electrical circuit including electrical switching means for connecting and disconnecting said light bulb to and from the power cells, said switching means being mounted in the open tail-end so as to retain the power cells in said casing;

means for retaining said electrical switching means in the tail-end such that said switching means can be easily removed and re-mounted;

an imperforate flexible boot for enclosing a portion of said switching means, said flexible boot having an open end including a peripheral sealing portion formed to fit between said switching means and said casing so as to from a watertight seal therebetween when said switching means is mounted in the tail-end of said casing; and the said electrical switching means comprising a pushbutton switch, the said pushbutton switch comprising a switch housing, a first resilient contact mounted in said switch housing, a second resilient contact mounted in said housing and electrically isolated from said first resilient contact, a third resilient contact coupled to said second resilient contact and mounted exteriorly on an end wall of said switch housing so as to contact a terminal of one of the power cells when said switching means is mounted in the tail-end of said casing, and retractable bridging means for coupling and uncoupling said first and second resilient contacts.

7. A flashlight comprising:

an elongated casing for holding one or more power cells, said casing having a head-end and an open tail-end;

a light bulb mounted at the head-end of said casing;

an electric circuit including electrical switching means for connecting and disconnecting said light bulb to and from the power cells, said switching means being mounted in the open tail-end so as to retain the power cells in said casing;

means for retaining said electrical switching means in the tail-end such that said switching means can be easily removed and re-mounted;

the said retaining means comprising a first plurality of helical threads formed in the interior of said elongated casing near the tail end thereof, and a second plurality of mating helical threads formed on the exterior of the electrical switching means, and an imperforate flexible boot for enclosing a portion of said switching means, said flexible boot having an open end including a peripheral sealing portion formed to fit between said switching means and said casing so as to form a watertight seal therebetween when said switching means is mounted in the tail-end of said casing, said peripheral sealing means of the boot being located between the open tail-end of the casing and said threads whereby when said electrical switching means is threaded into the tail-end of said casing, said boot excludes direct and moisture from said threads.

8. A flashlight as recited in claim 7 wherein said light bulb comprises a filament, a base contact connected to one end of said filament and a foot contact connected to the other end of said filament.

9. A flashlight as recited in claim 8 wherein said electric circuit comprises:

a first circuit leg connected at one end to the base contact and terminating at the other end in said electrical switching means; and a second circuit leg including the power cells connected at one end to the foot contact and terminating at the other end in said electrical switching means.

10. A flashlight as recited in claim 9 wherein said electrical switching means comprises a pushbutton switch.

11. A flashlight comprising:

an elongated casing for holding one or more power cells, said casing having a head-end and an open tail-end;

a light bulb mounted at the head-end of said casing;

an electric circuit including electrical switching means for connecting and disconnecting said light bulb to and from the power cells, said switching means being mounted in the open tail-end so as to retain the power cells in said casing;

means for retaining said electrical switching means in the tail-end such that said switching means can be easily removed and re-mounted;

an imperforate flexible boot for enclosing a portion of said switching means, said flexible boot having an open end including a peripheral sealing portion formed to fit between said switching means and said casing so as to form a watertight seal therebetween when said switching means is mounted in the tail-end of said casing;

the said light bulb comprising a filament, a base contact connected to one end of said filament and a foot contact connected to the other end of said filament;

the said electric circuit comprising a first circuit leg connected at one end to the base contact and terminating at the other end in said electrical switching means, and a second circuit leg including the power cells connected at one end to the foot contact and terminating at the other end in said electrical switching means, the said electrical switching means comprising a pushbutton switch, the said pushbutton switch comprising a switch housing, a first resilient contact mounted in said switch housing for terminating said first circuit leg, a second resilient contact mounted in said switch housing for terminating said second circuit leg, said second resilient contact being electrically isolated from said first resilient contact, and bridging means for electrically coupling and uncoupling said first and second resilient contacts, whereby said light bulb is connected and disconnected from the power cells.

12. A flashlight as recited in claim 11 wherein said first and second resilient contacts each comprise a coil spring.

13. A flashlight as recited in claim 12 wherein said pushbutton switch comprises protractable/retractable means for:

maintaining said bridging means in contact with said first and second resilient contacts when in a first position; and maintaining said bridging means out of contact with said first and second resilient contacts when in a second position.

14. For a flashlight of the type including a machined aluminum barrel for holding at least one power cell, a light bulb disposed at one end of said barrel, and wherein the barrel has an internally-threaded open tail-end;

a tail cap mounted in the open tail-end for retaining the power cell in the barrel, said tail cap including:

switching means formed in said tail cap for connecting and disconnecting said light bulb to and from the power cell;

external threads for mating with said internally threaded tail-end to retain said tail cap in the tail-end such that the tail cap can be easily installed and removed; and an imperforate flexible boot for enclosing at least a portion of said tail cap, said flexible boot having an open end including a peripheral sealing portion formed to fit between the tail cap and the barrel so as to form a watertight seal therebetween when the tail cap is mounted in the tail-end.

15. A tail cap for a machined aluminum flashlight as recited in claim 16 wherein said switching means comprises:

a switch housing formed of a non-conductive material and having an opening in a sidewall thereof;

a first resilient contact mounted in said switch housing such that a portion of said first resilient contact protrudes through the sidewall opening in said switch housing so as to interface with the barrel when the tail cap is installed therein;

a second resilient contact mounted in said switch housing and electrically isolated from said first resilient contact;

a third resilient contact coupled to said second resilient contact and mounted exteriorly on an end wall of said switch housing so as to contact a terminal of the power cell when the tail cap is mounted in the barrel; and bridging means for selectively coupling and uncoupling said first and second resilient contacts, whereby the light bulb is connected and disconnected from the power cell.

16. A tail cap for a machined aluminum flashlight as recited in claim 15 wherein each of said first, second and third resilient contacts comprises a spring coil having conductive spring wire convolutions providing said electrical connections, the portion of said first contact protruding through said opening comprising parts of said spring wire convolutions.

17. A tail cap for a machined aluminum flashlight as recited in claim 16 wherein said switching means comprises a switch housing having a peripheral groove formed therein, and the sealing portion of said flexible boot comprises:

an inwardly directed lip adapted to extend substantially around the open end, said lip being dimensioned and positioned to fit within the switch housing groove; and a bead projecting perpendicularly from said lip and adapted to extend substantially around the open end in an annular region between the switch housing and said casing.

18. A tail cap for a machined aluminum flashlight as recited in claim 14 wherein said flexible boot is in the form of a dome of imperforate, resilient, water-resistant material.

* * * * *